US006691984B2

(12) United States Patent
Alten

(10) Patent No.: US 6,691,984 B2
(45) Date of Patent: Feb. 17, 2004

(54) JACK

(75) Inventor: Ferdinand Alten, Mandern (DE)

(73) Assignee: ThyssenKrupp Bilstein GmbH, Ennepetal (DE)

( * ) Notice: Subject to any disclaimer, the term of this patent is extended or adjusted under 35 U.S.C. 154(b) by 0 days.

(21) Appl. No.: 10/332,497

(22) PCT Filed: Jun. 26, 2001

(86) PCT No.: PCT/EP01/07299

§ 371 (c)(1),
(2), (4) Date: Jan. 8, 2003

(87) PCT Pub. No.: WO02/08112

PCT Pub. Date: Jan. 31, 2002

(65) Prior Publication Data

US 2003/0155562 A1 Aug. 21, 2003

(30) Foreign Application Priority Data

Jul. 25, 2000 (DE) ..... 100 36 049

(51) Int. Cl.[7] ..... B66F 3/00

(52) U.S. Cl. ..... 254/126; 254/DIG. 1; 254/124

(58) Field of Search ..... 254/126, 100, 254/133, 122, DIG. 4, 134

(56) References Cited

U.S. PATENT DOCUMENTS 5,435,522 A * 7/1995 Brosius ..... 254/126
6,022,001 A * 2/2000 Palacio et al. ..... 254/126
6,189,865 B1 * 2/2001 Ruffie et al. ..... 254/126

* cited by examiner

*Primary Examiner*—Joseph J. Hail, III
*Assistant Examiner*—Daniel Shanley
(74) *Attorney, Agent, or Firm*—Max Fogiel

(57) ABSTRACT

The invention relates to a jack with supporting parts, which are provided as profiles that have U-shaped cross-sections and lateral profile limbs (15, 17) or which are provided as elements with laterally elevated sheet metal lobes (13). Said supporting parts are pivotally interconnected by joints (5, 6) in such a manner that the lateral profile limbs (15, 17) and/or the elevated sheet metal lobes (13) overlap in the vicinity of the joints (5, 6), and arbors pass through borings in the lateral profile limbs (15, 17) or elevated sheet metal lobes (13). The aim of the invention is to reduce the weight of a jack of the aforementioned type as well as the risk of the profile limb (15, 17) kinking. To this end, the bottom of the U-shaped profile or element which, with the profile limbs (15) or sheet metal lobes (13) thereof, tightly surrounds the other profile or element, is provided with beads (19, 21) or lobes (24), which inwardly project and which are arranged inside, however, near the profile limbs (15, 17) or sheet metal lobes of the other profile or element.

10 Claims, 4 Drawing Sheets

JACK

BACKGROUND OF THE INVENTION

The load-bearing components of jacks are articulated to one another at pivoting joints. Most of these parts are shaped out of structural U section. Other load-bearing components, the head and the foot for instance, are provided with laterally elevated flaps. The load-bearing components are attached by overlapping the lengths of section or tabs in the vicinity of the articulations, providing them with bores, and inserting pivots through the bores. German OS 2 231 526 discloses joints of this nature, with pivots in the form of bolts. The pivots disclosed in European Patent 0 332 565 A1 on the other hand are stamped-out necks.

There is a drawback to this system. The lengths of section and tabs in particular must be very thick, especially at their ends, in the vicinity of the joints, that is, to prevent them from buckling subject to lateral forces to the detriment of overall stability. The extra material adds to the weight.

Summary of the Invention

The object of the present invention is a lighter-weight jack with lengths of section that will not buckle.

The jack in accordance with the present invention is lighter in weight than a conventional jack but can support just as heavy a load while remaining reliably upright. The reinforcing welts along the load-bearing components also augment overall stability.

BRIEF DESCRIPTION OF THE DRAWINGS

Embodiments of the present invention will now be specified with reference to the accompanying drawing, wherein.

DESCRIPTION OF THE PREFERRED EMBODIMENTS

Figure 1:
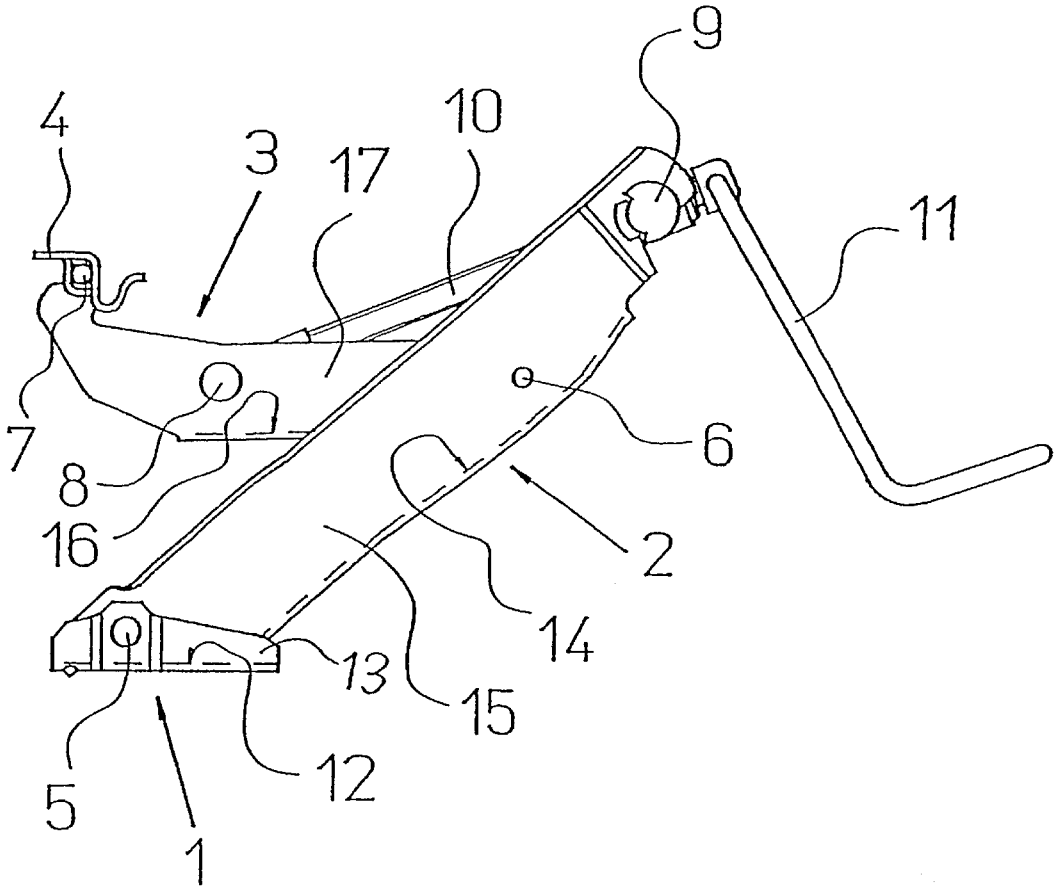
FIG. 1 is a view of an articulated jack.

Jacks of all types include mutually articulated load-bearing components between the foot and the leg. These components must be strong enough to sustain the weight of a motor vehicle. They must accordingly function reliably. Although the jack illustrated in FIG. 1 herein represents only one species, the present invention applies to all jacks of the type presented in this application. The load-bearing components of the jack illustrated in FIG. 1 comprise a foot 1, a leg 2, an arm 3, and vehicle supporting plate 4. All these parts are connected at articulated joints 5, 6, and 7. A threaded spindle 10 is articulated to leg 2 at a joint 9 and to arm 3 at a joint 8 and, rotated by a crank 11, raises arm 3 away from foot 1 by way of a threaded nut.

The body of foot 1 comprises a web 12 with laterally elevated sheet-metal tabs 13. Leg 2 on the other hand is a length of U section with a web 14 and flanges 15. Arm 3 itself is a length of U section with a web 16 and flanges 17. The joints specified herein are particularly appropriate for attaching an arm 3 to a leg 2 or a leg 2 to a foot 1 in a jack of the illustrated species.

FIGS. 2 through 7 are larger-scale details depicting how a leg 2 can be articulated to a foot 1. The joints 5 depicted in FIGS. 2 through 5 employ bolts 18 with heads at each end and extending through bores in the tabs 13 in foot 1 and in the flanges 15 on leg 2.

Figure 2:
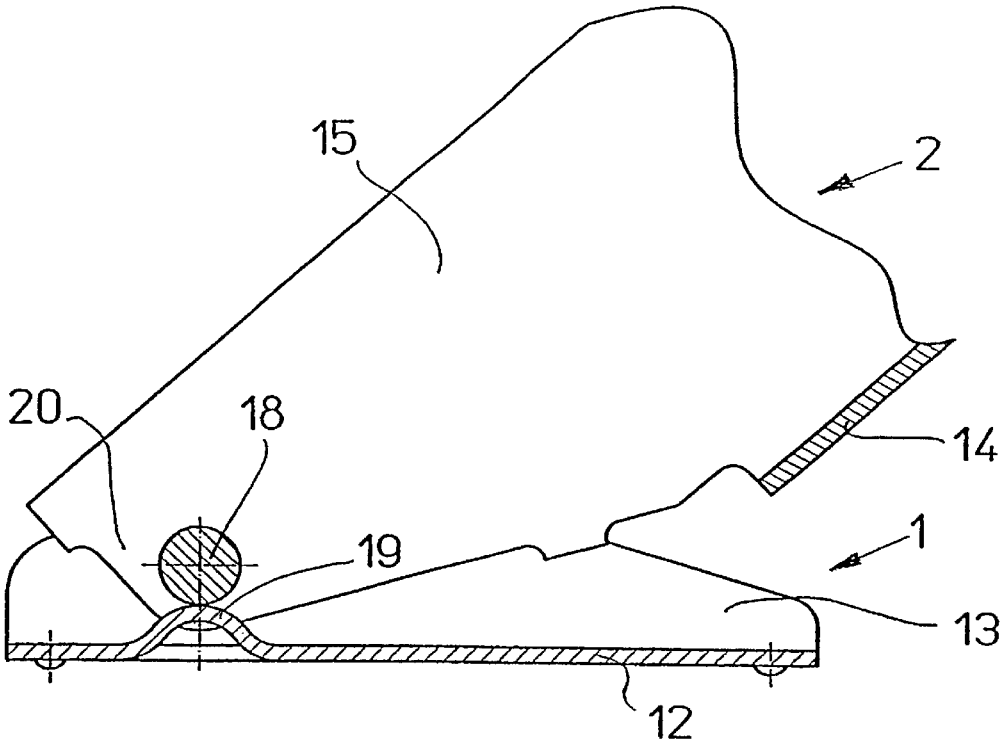
FIG. 2 is a larger-scale detail of the joint between the foot and the leg.
Figure 3:
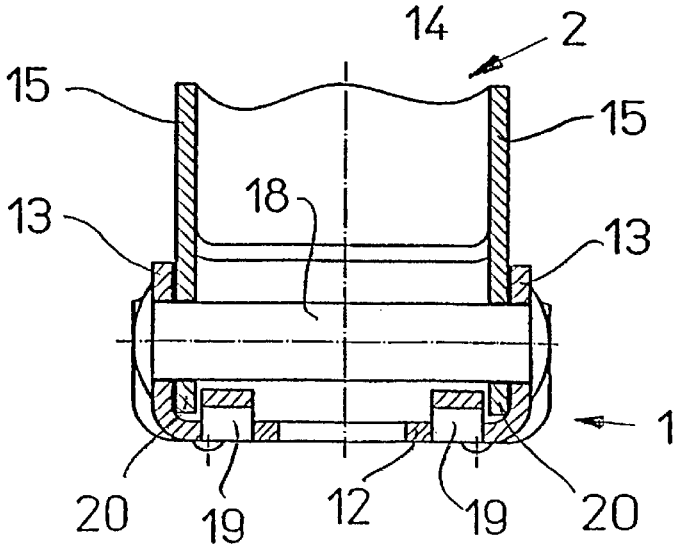
FIG. 3 is a 90°-rotated section through the joint illustrated in FIG. 2.

The embodiments illustrated in FIGS. 2 and 3 feature inwardly elevated reinforcing welts 19 stamped out of each side of the web 12 in foot 1. Welts 19 are located inside flanges 15 and close to them. Only enough play is left between the tabs 13 on foot 1, the flanges 15 of leg 2, and welts 19 to allow the pivoting action to take place, securely positioning the ends 20 of flanges 15. Welts 19 extend to below bolts 18, allowing the bolts to rest against them when necessary.

Figure 4:
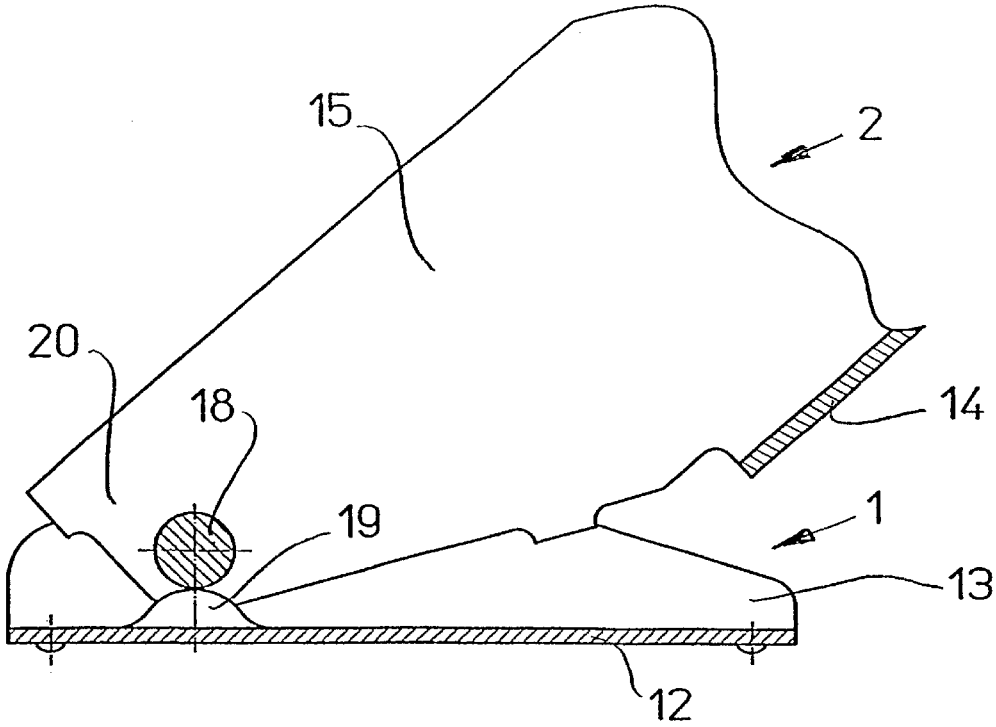
FIG. 4 is a larger-scale detail of the joint between the foot and the leg.
Figure 5:
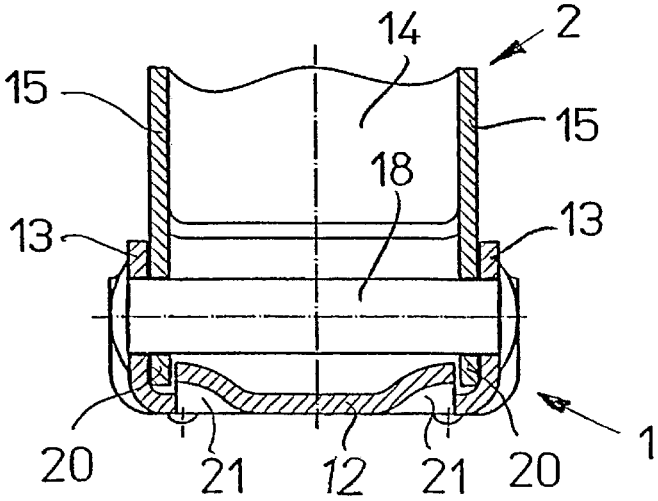
FIG. 5 is a 90°-rotated section through the joint illustrated in FIG. 4.

The embodiment illustrated in FIGS. 4 and 5 is similar to the ones illustrated in FIGS. 2 and 3. Here, welts 21 are stamped upward out of the web 12 in foot 1 and are separated from that web along only one edge, remaining integrated into it along the other edge.

Figure 6:
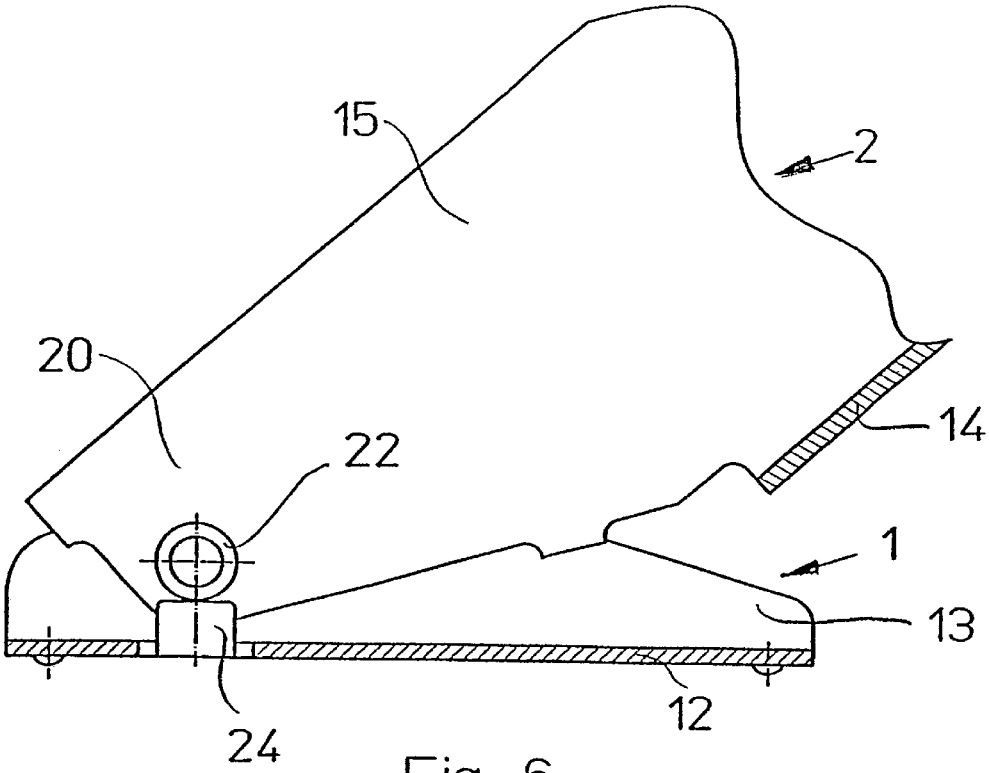
FIG. 6 is a larger-scale detail of a joint between the foot and the leg in the form of necks stamped out of the foot and engaging bores in the leg.
Figure 7:
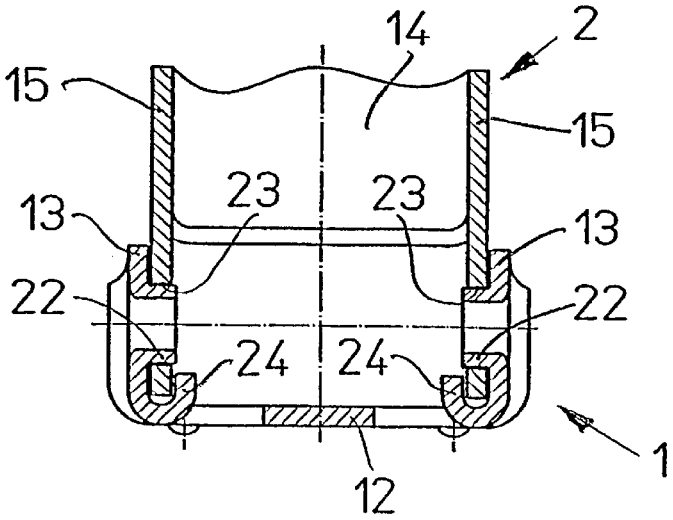
FIG. 7 is a 90° shifted sectional view of a portion of the embodiment shown in FIG. 6.

The joints 5 in the embodiment illustrated in FIGS. 6 and 7 are in the form of inward-projecting necks stamped out of the tabs 13 on foot 1 and extending into bores 23 that extend through the flanges 15 of leg 2. The ends 20 of flanges 15 are secured in this embodiment by inward-extending tabs 24. Tabs 24 are, like welts 19 and 20, stamped up out of the web 12 of foot 1.

| List of parts | |
|---|---|
| 1. | foot |
| 2. | leg |
| 3. | arm |
| 4. | vehicle-supporting plate |
| 5. | joint |
| 6. | joint |
| 7. | joint |
| 8. | joint |
| 9. | joint |
| 10. | spindle |
| 11. | crank |
| 12. | web |
| 13. | tab |
| 14. | web |
| 15. | flange |
| 16. | web |
| 17. | flange |
| 18. | bolt |
| 19. | welt |
| 20. | end of flange 15 |
| 21. | welt |
| 22. | neck |
| 23. | bore |
| 24. | tab |

What is claimed is:

1. A jack with load-bearing components comprising lengths of structural U section with lateral flanges articulated together at joints and overlapping in vicinity of said joints; said joints comprising bores extending through said flanges and tabs and pivots extending through said bores; a web in a length of section with flanges overlapping another length having an inward-projecting welt to prevent buckling of the jack when under load and free of added weight.

2. The jack as defined in claim 1, wherein said welt is stamped out along both edges.

3. The Jack as defined in claim 1, wherein said welt is stamped out along only one edge.

4. The jack as defined in claim 1, wherein said welt extends closely to said joints.

5. The jack as defined in claim 1, wherein said joints are bolts.

6. A jack with load-bearing components comprising lengths of structural U section with lateral flanges articulated together at joints and overlapping in vicinity of said joints; said joints comprising bores extending through said flanges and tabs and pivots extending through said bores; a web in a length of section with flanges overlapping another length having an inward-projecting welt to prevent buckling of the jack when under load and free of added weight; said joints being stamped-out necks.

7. A jack with load-bearing components comprising lengths of structural U section with lateral tabs articulated together at joints and overlapping in vicinity of said joints; said joints comprising bores extending through said flanges and tabs and pivots extending through said bores; a web in a length of section with flanges overlapping another length having an inward-projecting welt to prevent buckling of the jack when under load and free of added weight.

8. A jack with load-bearing components comprising length of structural U section with lateral flanges articulated together at joints and overlapping in vicinity of said joints; said joints comprising bores extending through said flanges and tabs and pivots extending through said bores; a web in a length of section with flanges overlapping another length having an inward-projecting tab to prevent buckling of the jack when under load and free of added weight.

9. The jack as defined in claim 1, wherein said tab extends closely to said joints.

10. The jack as defined in claim 1, wherein said joints are bolts.

* * * * *